United States Patent [19]

Bodzin

[11] Patent Number: 5,076,545

[45] Date of Patent: Dec. 31, 1991

[54] CHILD'S BANISTER GUARD

[76] Inventor: Leon J. Bodzin, 14617 Carmel Ridge Rd., San Diego, Calif. 92128

[21] Appl. No.: 588,333

[22] Filed: Sep. 26, 1990

[51] Int. Cl.[5] ..... E04H 17/00

[52] U.S. Cl. ..... 256/1; 256/29; 256/24

[58] Field of Search ..... 256/1, 29, 24; 5/427, 5/425

[56] References Cited

U.S. PATENT DOCUMENTS 4,155,540 5/1979 Horgan, Jr. ..... 256/24 X
4,852,194 8/1989 Langen ..... 256/24 X

FOREIGN PATENT DOCUMENTS 615470 2/1961 Canada ..... 256/24

*Primary Examiner*—Andrew V. Kundrat
*Attorney, Agent, or Firm*—George J. Rubens

[57] ABSTRACT

A child's safety guard for baluster-type banisters designed to prevent any portion of a child's body from falling through or being jammed between adjacent balusters and railings, without degrading the aesthetic appearance of the banisters. The guard comprises a set of thin, substantially stiff panels of sheet material having a parallelogram configuration capable of being adjustably overlapped along adjacent edges to cover substantially the entire space facing the landing between the railings. The panels are secured in their overlapped position by a lacing threaded through a series of drilled openings along the top and bottom edges of the panels and around the balusters. The panels are preferably fabricated of a clear, plastic material, but can be made in any desired color.

10 Claims, 1 Drawing Sheet

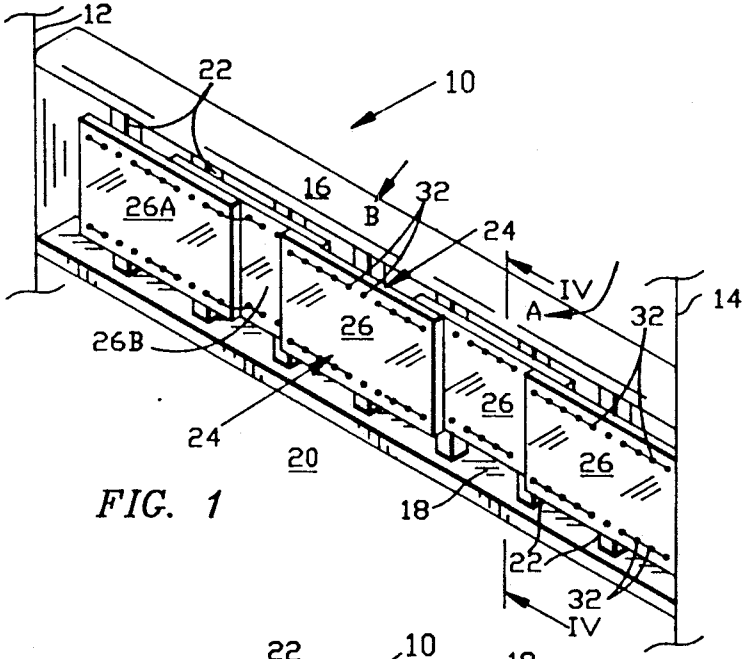
FIG. 1
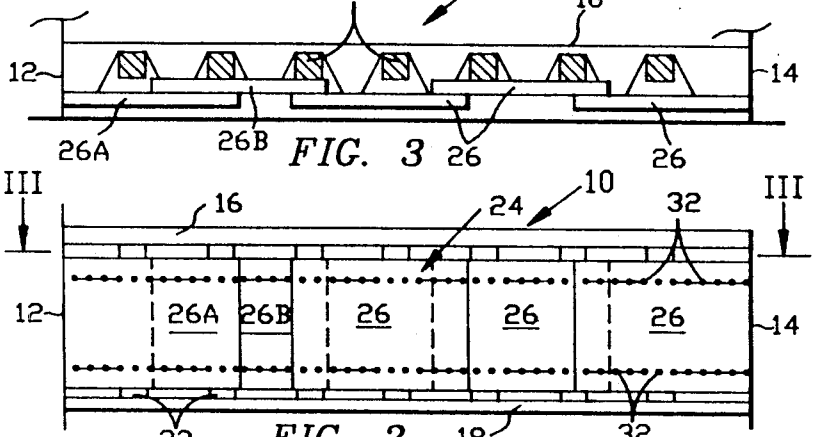
FIG. 2
FIG. 3
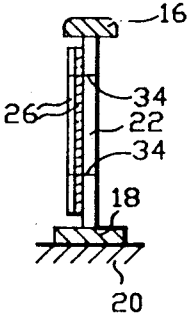
FIG. 4
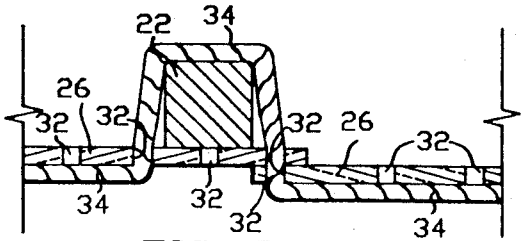
FIG. 5
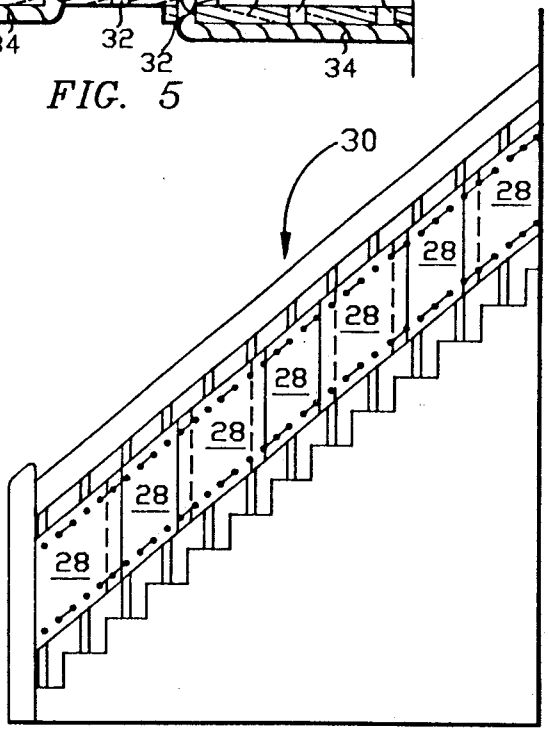
FIG. 6

CHILD'S BANISTER GUARD

PREAMBLE

The invention pertains to child's safety equipment, and more specifically to a safety guard or shield for baluster-type banisters for preventing any portion of a child's body from falling through or being jammed between the balusters and railings.

It is common in buildings having more than one level, or having an exterior porch or balcony, to provide a banister for landings or stairs having vertical, horizontally spaced supporting members referred to as balusters. Although local building codes usually regulate the safe lateral spacing between the balusters nevertheless it is quite possible for young, inquisitive children playing around said balusters to pass through or jam some portion of the body, frequently the head which may become jammed between the balusters and the railings.

A U.S. Pat. No. 4,852,194 by Langan, issued on Aug. 1, 1989 addresses this problem by using a flexible fabric netting which is stretched along a porch banister to function as a barrier for small children. The patented barrier is provided with a cord threaded between the upper and lower edges of the netting and around the hand rail and lower baluster mounting railing respectively, for stretching the flexible netting there between. If the particular banister construction does not have a lower mounting railing, the lower edge of the netting barrier is anchored to the floor, as well as to the end walls, by eye-screws. Although this patented barrier provides a degree of protection for small children playing around the banister balusters, it does present some disadvantages.

The use of a resilient fabric netting does not prevent a child's fingers and toes from being caught in the netting. The fabric netting presents a visual barrier by detracting from the appearance of the stairway or landing in a home. In addition, using a cord to stretch the fabric netting around the hand railing, in addition to detracting from the appearance of the banister, presents the possibility of a child, as well as an adult, of snagging their fingers on the cord as they slide their hands along the hand railing as they walk alongside the banister. Stretching the fabric netting along the banister will eventually cause the netting to expand and lose its shape, potentially allowing a child to become jammed between adjacent balusters, thereby reducing its effectiveness as a child's barrier. Furthermore, if the banister is not constructed with a lower railing spaced above the floor on which the balusters are mounted, it is necessary to anchor the lower edge of the flexible netting to the floor by eye-screws which can snag a child's toes.

The present invention overcomes the above described disadvantages of the prior art device. The use of solid, stiff panels eliminates the possibility of a child snagging their fingers in the netting or the cord that is used to stretch the netting over the hand rail of the banister, or the stretching of the fabric material beyond its original size. The novel solid panels can be easily cleaned in their installed position, whereas the prior art fabric netting requires removal from the banister and re-installation. Most important, subject invention panels can be standardized in size, and readily adjustable to fit any length banister by overlapping the adjacent sides of the panels to the degree necessary. The provision of drilled apertures along the top and bottom edges of each panel, in addition to allowing adjustability to the length of any banister, enables the panels to be secured in position only to the balusters instead of being secured to the railings as in the prior art. Using clear panels makes the present invention guard near-invisible when installed, thereby preserving the aesthetic quality of the banister.

BRIEF SUMMARY OF THE INVENTION

A novel child's guard is provided to prevent a child from passing through or being jammed between adjacent balusters of conventional banisters of stairways, landings and porches. The novel guard consists of a combination of a plurality of standard size panels of thin, solid sheet material, preferably of clear plastic, so as not to detract from the aesthetic appearance of home banisters. The upper and lower ends of the panels are secured only to the balusters to keep the hand railing smooth and free of any obstruction to the sliding movement of the hands along the hand rail. Use of a standard size panel enables the guard to be adjusted to any banister length by overlapping the adjacent sides of the panels to the degree necessary.

This adjustability of the novel guard is accomplished by drilling a series of equally spaced apertures along the upper and lower edges of each panel. These apertures are adapted to receive a flexible cord that is laced through matching apertures, where necessary in overlapping panels of adjacent panels, and around the respective balusters to maintain the set of panels in the selected position on the banister. Each panel can be in the shape of a parallelogram, either square or rectangular, that can be attached to banisters on stairways or landings, or can be fabricated in the shape of rhomboids to match the inclination of the stairway.

OBJECTS OF THE INVENTION

A principal object of the invention is to provide a banister guard to prevent injury to children around the hand railing and balusters of the banister.

Another important object is to provide such a guard made of thin rigid, solid panels of a uniform size that can be adjustably secured on the banister in juxtaposition to fit any length banister.

Still another object is to provide a guard having means for securing the panels in adjusted position to only the balusters, eliminating the need for screw fasteners that can deface the walls and floors to which they are mounted.

A further object is to provide a guard that can be readily cleaned without its removal from the banister.

Still a further object is to provide a guard that will not detract from the appearance of the banister, especially one located in the interior of a home.

BRIEF DESCRIPTION OF THE DRAWINGS

FIG. 1 is a perspective view of the novel child's guard mounted to a baluster-type banister extending between and mounted to opposite walls.

FIG. 2 is a front elevation view of the banister in FIG. 1, showing the novel guard facing a landing.

FIG. 3 is a top view of the banister taken along line III—III of FIG. 2.

FIG. 4 is a cross-section view of the railing taken along line IV—IV of FIG. 1.

FIG. 5 is an enlarged top view of one of the balusters in FIG. 1 showing the manner of lacing adjacent ends of overlapping panels located at a respective baluster.

FIG. 6 is a front elevation view of a portion of a stair banister showing the use of rhomboid-shaped panels attached to the balusters.

DETAILED DESCRIPTION OF THE INVENTION

Referring to the drawing where like reference numerals refer to similar parts throughout the figures, there is shown in FIG. 1 a typical banister 10 extending between and secured to opposite walls 12 and 14, which walls may be located inside or outside a building. This type of conventional banister includes an upper horizontal hand rail 16, and a lower horizontal mounting rail 18, which may be mounted directly on a floor or decking 20, or spaced slightly above the floor, not shown. Supporting the two rails 16 and 18 are a combination of horizontally spaced, vertical support members 22, sometimes referred to as balusters.

Although some local municipal ordinances specify a safe horizontal spacing between adjacent balusters to minimize the likelihood of injury to children passing through or jamming parts of their body, frequently the head, between the balusters, nevertheless, such accidents do occur to children playing near the banisters. Even death can occur from a child passing through and subsequently falling from said banister to the level below.

To prevent such children's injuries, a novel guard or shield 24 is provided consisting of a set of individual panels 26, preferably of a uniform size and shape, having a height that will substantially cover the vertical spacing between the rails, and for the length of the banister, as shown in FIGS. 1-3. Each panel 26 is configured as a parallelogram, either square or rectangular, for landings as shown in FIGS. 1-3, and which can also be used to cover substantially all of a stair banister 30 (FIG. 6). Panels 26 can also be configured as rhomboids 28 for use on the stair banister 30, as shown in FIG. 6, to match the inclination of the stairway.

Each panel 26 or 28 is made of a thin, somewhat rigid, plastic material, preferably clear and transparent so as not to distract from the appearance of the banister, although such panels can be colored to match the surrounding decor or to provide privacy or sun blockage when used on exterior banisters.

An important feature of the invention is the manner of securing the panels only to the balusters without the need of any attachment to or around the hand rails or mounting rails that otherwise would create an obstruction to their normal use, or the need for special attachment fasteners. This object is achieved by providing each panel 26 or 28 with a series of equally spaced drilled apertures or openings 32 horizontally extending along the upper and lower sides of the panels along their edges. The drilled openings 32 can be spaced apart about two inches to accommodate the width of the average baluster.

As best shown in FIG. 5, as well as in FIGS. 1-3, a flexible cord or lacing 34 is threaded snugly through one of the openings 32 and around each adjacent baluster 22, and back through the next available opening in the same panel, as shown in FIG. 1, or through aligned openings in abutting panels should the overlapping panels be positioned at a particular baluster, as illustrated in FIG. 5. When pulled tight and the ends knotted, lacings 34 will maintain the panels in any desired position between the hand and mounting rails 16 and 18, respectively.

The entire length of the set of panels 26 and 28 can be adjusted to accommodate any length banister by equally varying the amount of overlapping between all adjacent panels, or between the last two panels at one end of the banister, as shown by panels 26*a* and 26*b* in FIG. 1. The adjustability feature between the panels is assured by providing the series of drilled openings uniformly spaced along a major portion of the entire length of the upper and lower sides of each panel. In addition, the spacing of openings 32 in each panel makes it possible of always having available openings adjacent each baluster wherever the balusters may occur with respect to the panels, as clearly shown in FIG. 1. In other words, the panels may be laced to a respective baluster at overlapping ends of the panels as shown in FIG. 5 and at position A in FIG. 1, or at a position anywhere intermediate the panels as shown at position B in FIG. 1. In addition, the overlapping ends of adjacent panels are snugly secured together by cord 34 wherever they occur between balusters to prevent a child from having their fingers pinched between the overlapping ends of adjacent panels.

The present children's banister guard provides unique advantages over prior art devices in that the guard is constructed of a set of thin, stiff, solid, uniformly shaped panels that can be adjusted to any length banister and will not distract from its appearance; will not change its shape over extended use; can be readily cleaned without its removal and re-installation on the banister; and can be easily installed on a banister without the need for tools, or use of screw fasteners that will deface the walls and floors to which they are attached.

I claim:

1. A child's safety guard for conventional baluster-type banisters having horizontally spaced vertical supporting banister ends comprising;

a plurality of independent thin, substantially stiff panels of solid sheet material each capable of being adjustably juxtapositioned with an adjacent panel to fill the space between the ends of the banister and of a size to substantially fill the space defined by the height of said balusters, and means for securing said panels only to said balusters in the adjusted position.

2. The safety guard of claim 1 wherein a substantial number of said panels are of uniform size.

3. The safety guard of claim 2 wherein said panels have a parallelogram configuration.

4. The safety guard of claim 3 wherein said panels have a rhomboidal configuration.

5. The safety guard of claim 1 wherein said panels are made of plastic material.

6. The safety guard of claim 5 wherein said panels are made of a clear, colorless, plastic material.

7. The safety guard of claim 1 wherein said panels have upper and lower sides, each side having a plurality of spaced openings extending aligned substantially parallel to their edges, a flexible cord extending through selected openings in said panels and around adjacent balusters, functioning as the means for securing said panels to the balusters.

8. The safety guard of claim 7 wherein said openings are uniformly spaced and extend completely across said panels.

9. A guard for conventional baluster-type banisters having horizontally spaced vertical supporting banister ends comprising;

a plurality of independent thin, substantially stiff panels of solid sheet material, a substantial number of said panels having a parallelogram configuration;

said panels capable of being adjustably juxtapositioned with adjacent panels to fill the entire horizontal space between the ends of said banister, and of a size to substantially fill the vertical space defined by the height of said balusters;

each of said panels having upper and lower sides provided with a plurality of horizontally spaced openings;

a flexible cord capable of being threaded through said openings and only around the balusters for securing said panels in a selected position on said banister.

10. The guard of claim 9 wherein said panels are made of a clear, plastic material, and said openings extend completely across each of said panels.

* * * * *